US005257798A

United States Patent [19]

Stritzl et al.

[11] Patent Number: 5,257,798

[45] Date of Patent: Nov. 2, 1993

[54] FRONT JAW

[75] Inventors: Karl Stritzl; Helmut Wladar, both of Vienna; Andreas Janisch, Oeyenhausen; Hubert Wuerthner, Hainburg/Donau, all of Austria

[73] Assignee: HTM Sport-und Freizeitgeraete Gesellschaft m.b.H., Schwechat, Austria

[21] Appl. No.: 941,142

[22] PCT Filed: Mar. 25, 1992

[86] PCT No.: PCT/EP92/00653

§ 371 Date: Nov. 3, 1992

§ 102(e) Date: Nov. 3, 1992

[87] PCT Pub. No.: WO92/17250

PCT Pub. Date: Oct. 15, 1992

[30] Foreign Application Priority Data

Mar. 28, 1991 [AT] Austria ..... 684/91

[51] Int. Cl.[5] ..... A63C 9/08

[52] U.S. Cl. ..... 280/625; 280/628

[58] Field of Search ..... 280/628, 629, 634, 625, 280/626

[56] References Cited

U.S. PATENT DOCUMENTS 4,372,574 2/1983 Svoboda et al. ..... 280/634
4,572,541 2/1986 Bernard et al. ..... 280/628
5,033,768 7/1991 Stritzl ..... 280/625
5,149,124 9/1992 Wittman et al. ..... 280/628 X

FOREIGN PATENT DOCUMENTS 0408855 1/1991 European Pat. Off. ..... 280/628
0415006 3/1991 European Pat. Off. ..... 280/625
2448769 4/1976 Fed. Rep. of Germany ..... 280/628

*Primary Examiner*—Margaret A. Focarino
*Assistant Examiner*—Peter C. English
*Attorney, Agent, or Firm*—Flynn, Thiel, Boutell & Tanis

[57] ABSTRACT

A front jaw for a ski binding having a housing (2) in which is housed a release spring (40). The release spring (40) loads a pull rod (10) extending through the release spring, which pull rod acts onto the shorter lever arms (36) of two toggle levers (35) through a release plate (13), which toggle levers are pivotal about vertical axes (34) on a bearing part (20) and the longer lever arms of which toggle levers are designed as sole holders (37). The bearing part (20) has a through opening (21) for the pull rod (10) and has at its lower end section a rearwardly directed projection (31) for abutment against the release plate (13). The release plate (13) has at a lower section thereof (14) on a side opposing the bearing part (20) a control surface (15) which, when viewed in a longitudinal cross section, extends upwardly and forwardly. The rearwardly directed projection (31) on the bearing part engages a control surface (15) when an upwardly directed force to the sole holders (37) occurs.

4 Claims, 3 Drawing Sheets

FRONT JAW

FIELD OF THE INVENTION

The invention relates to a front jaw of a ski binding.

BACKGROUND OF THE INVENTION

Such a front jaw is for example described in EP-A2-0 408 855. The release plate is designed flat in the vertical direction in this known solution. The bearing part has in its lower end section a rearwardly extending projection against which the release plate rests.

This solution is by all means practical, however, it has been found that the flat design of the release plate results in a regressive release behavior of the ski binding when a vertical force is applied. An object of the invention is to provide a front jaw of the above-mentioned type such that the release behavior of the ski binding is linear or slightly progressive.

SUMMARY

The objects and purposes of this invention are met by providing a front jaw for a ski binding having a housing in which is housed a release spring. The release spring loads a pull rod extending through the release spring, which pull rod acts onto the shorter lever arms of two toggle levers through a release plate, which toggle levers are pivotal about vertical axes on a bearing part and the longer lever arms of which toggle levers are designed as sole holders. The bearing part has a through opening for the pull rod and has at its lower end section a rearwardly directed projection for abutment against the release plate. The release plate has at a lower section thereof on a side opposing the bearing part a control surface which, when viewed in a longitudinal cross section, extends upwardly and forwardly. The rearwardly directed projection on the bearing part engages a control surface when an upwardly directed force to the sole holders occurs.

Due to o the fact that the lower section of the release plate has a control surface on its side facing the bearing part and that the control surface, viewed in a side longitudinal cross section, extends upwardly and forwardly, a course of the force action line, which course is favorable for a linear or slightly progressive release behavior of the ski binding, is achieved in cooperation with the rearwardly directed projection of the bearing part. It is possible to design the control surface as a forwardly rising flat surface, however, it has proven to be advantageous to design the control surface of the release plate continuously curved.

BRIEF DESCRIPTION OF THE DRAWINGS

Further advantages, characteristics and details of the front jaw of the invention will now be described in greater detail in connection with the drawings, in which.

DETAILED DESCRIPTION

Figure 1:
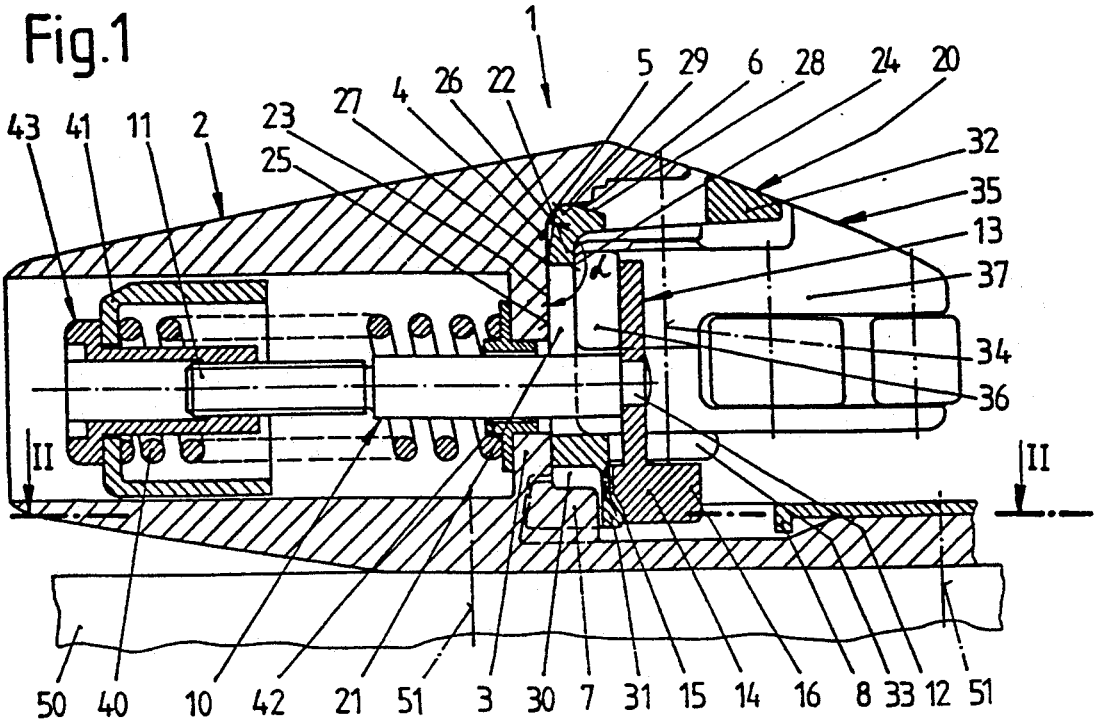
FIG. 1 is a longitudinal cross-sectional view of the front jaw of the invention in the position of the ski binding ready to be stepped into.

FIG. 1 illustrates a front jaw of the invention in a position in which it is ready to be stepped into. The front jaw has a housing 2 which is fastened to a ski 50 by means of screws 51, which are only schematically indicated. A release spring 40 is housed in the housing 2, the initial tension of which spring can be adjusted in a conventional manner by an adjusting device 43. The release spring 40 is arranged between a spring plate 41 and, with an interpositioning of a bearing sleeve 42, a vertically extending rear crosswall 3 of the housing 2. A pull rod 10 extends coaxially through the center of the release spring 40, one end 11 of the pull rod cooperating with the adjusting device 43 and the other end 12 of the pull rod being connected to an essentially vertically extending release plate 13. The release plate 13 has a control surface 15 at its lower end 14, which control surface will be described in greater detail below, and extends toward the tip of the ski, and a rearwardly extending stop 16 extends in a direction toward the shoe to be inserted.

Figure 2:
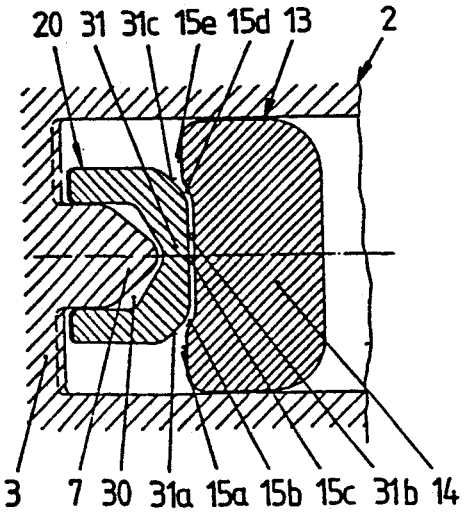
FIG. 2 is a cross-sectional view of a detail of the front jaw taken along the line II—II of FIG. 1.

A first curved surface 5 is provided at the juncture of the top of the vertically extending rear crosswall 3 of the housing 2 and a horizontally rearwardly extending section 6. A bearing part 20 having a support wall 22 rests on the backside 4 of the rear crosswall 3 of the housing 2 in a position of the front jaw 1 ready to be stepped into. The bearing part 20 has, viewed from the rear, a framelike shape, namely it has a through opening 21 for the pull rod 10, and has, viewed in a side view, the approximate shape of a C. The vertically extending section of the C is formed by the support wall 22 and is equipped with a frontwardly facing bearing surface 23 and a rearwardly facing bearing surface 24. Two, only schematically indicated, axes 34 for toggle levers 35 are symmetrically arranged with respect to the longitudinal center axis of the front jaw 2 in the upper and lower legs 32, 33 of the C. The shorter lever arms 36 of the two toggle levers 35 are supported on the one side thereof on the release plate 13 and on the other side thereof on the rearwardly facing bearing surface 24 of the bearing part 20. The longer lever arms of the toggle levers 35 are constructed as sole holders 37 for the ski shoe (not illustrated). The frontwardly facing bearing surface 23 of the bearing part 20 has two sections abutting in elevational direction, viewed in the position of the front jaw 2 ready to be stepped into, with a lower section 25 thereof resting on the backside 4 of the rear crosswall 3 of the housing 2. The upper section 26 defines an obtuse angle a with the lower section 25. The bearing part 20 has an edge 27 defining a pivot between the upper section 26 and the lower section 25. The upper leg 32 of the bearing part 20 is equipped with a rearwardly and downwardly inclined surface 28 in the area of the longitudinal center axis. The transition between the upper section 26 of the frontwardly facing bearing surface 23 and the rearwardly and downwardly inclined surface 28 is designed as a further curved surface 29. The bearing part 20 is designed fork-shaped in the top view in its lower section in the area of the longitudinal center axis and has a forwardly open recess 30 and a rearwardly directed projection 31, which will yet be described in greater detail. A suitable pointed projection 7 on the housing 2 is received in the recess 30. A path-defining means 8 facing the stop 16 on the release plate 13 is furthermore arranged on the housing 2. The control surface 15 is forwardly inclined upwardly (toward the tip of the ski) and is continuosly curved. A horizontal cross section (see FIG. 2) reveals that the control surface 15 consists essentially of a first section 15*a* extending approximately transversely with respect to the longitudinal axis of the ski, a following, rearwardly curved second section 15*b*, a third section 15*c* extending approximately transversely with respect to the longitudinal direction of the ski and following the second section 15*b*, a forwardly curved section 15*d* following the third section 15*c*, and a fifth section 15*e* extending again approximately transversely with respect to the longitudinal axis of the ski and following the fourth section 15*d*.

The rearwardly extending projection 31 on the bearing part 20 is conformed to the shape of the control surface 15 and has also a rearwardly curved first section 31*a*, followed by a second section 31*b* extending approximately transversely with respect to the longitudinal axis of the ski, and thereafter a forwardly curved third section 31*c*.

Figure 4:
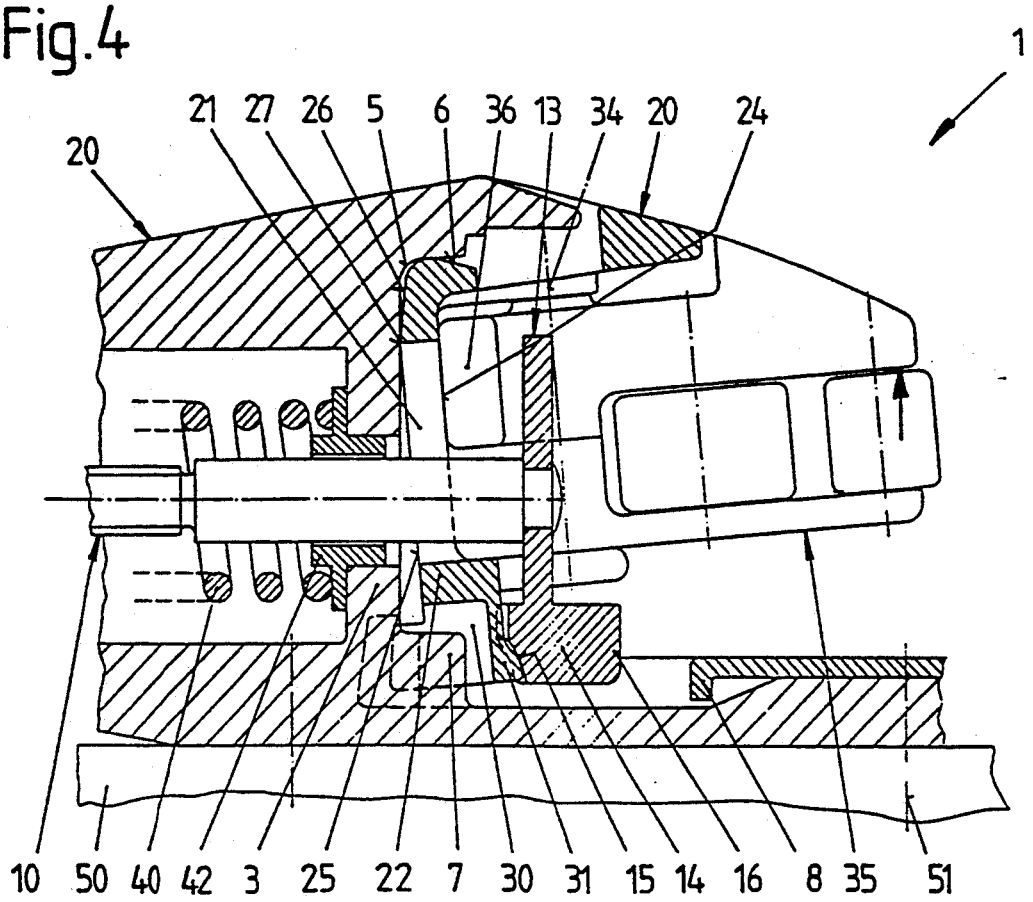
FIG. 4 is a longitudinal cross-sectional view of part of the front jaw in a slightly upwardly swiveled state.
Figure 4A:
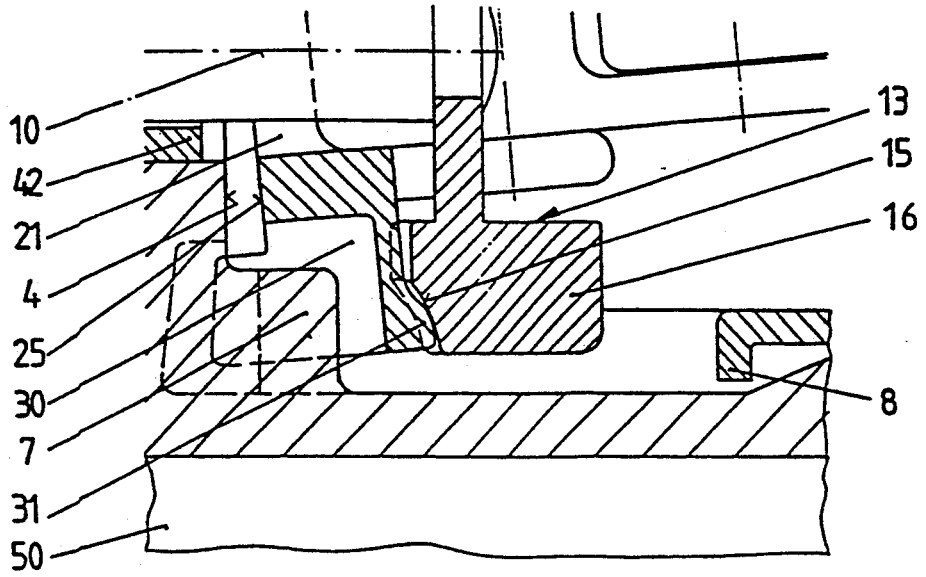
Figure 5:
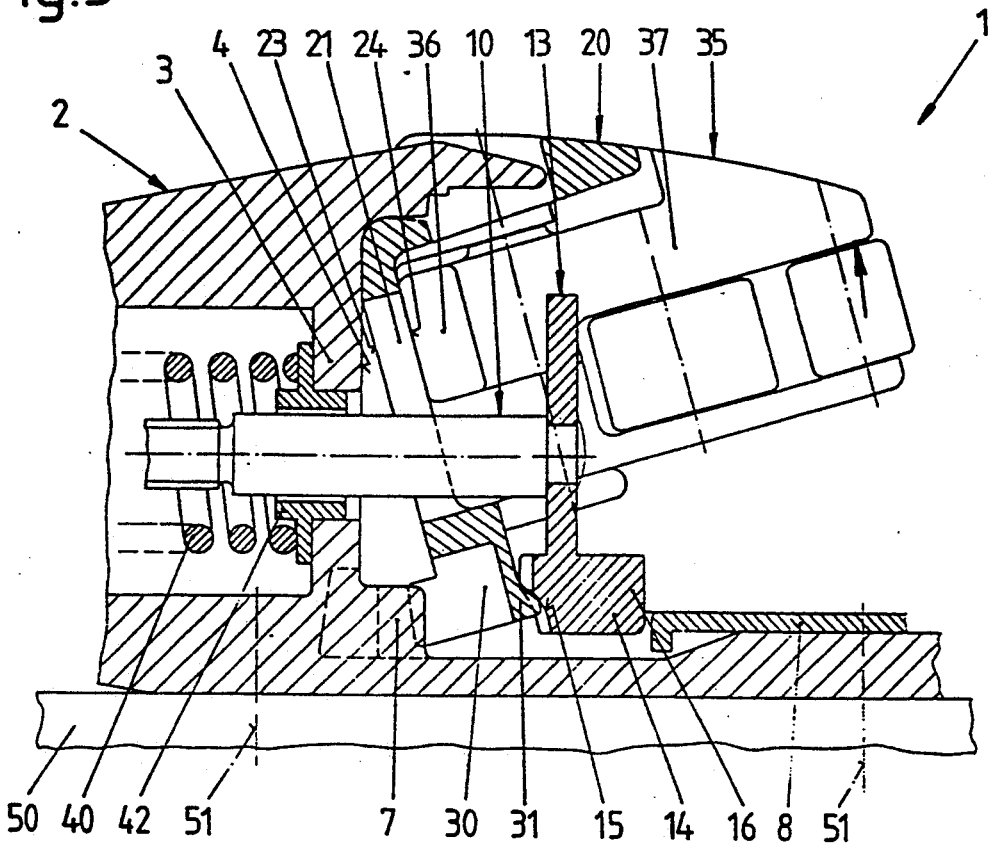
FIG. 5 is an illustration like FIG. 4, with the sole holders being swiveled farther upwardly, and FIGS. 4*a* and 5*a* each show details of FIGS. 4 and 5 in an enlarged scale.
Figure 5A:
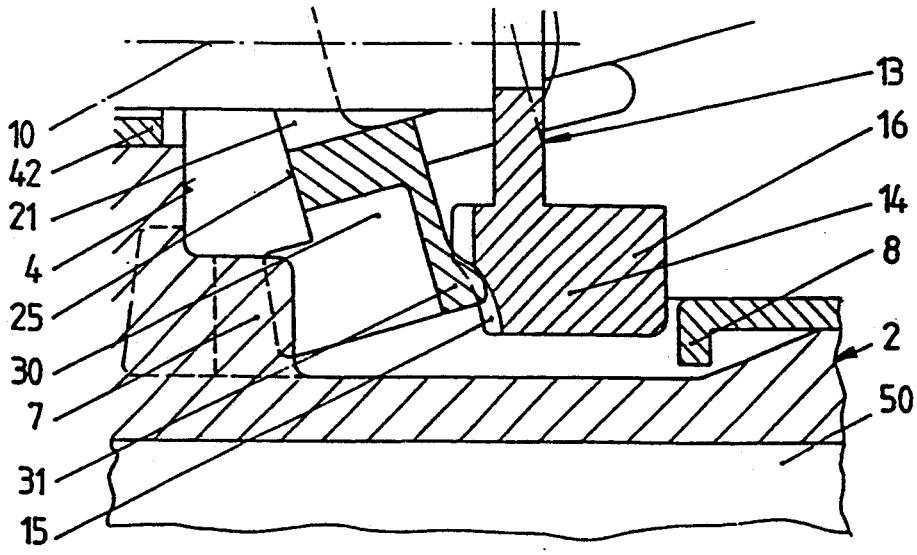

FIGS. 4 and 5 show how the bearing part 20 and toggle lever 35 are swiveled during an upwardly directed increased force, for example, during a backward fall or a backward twisting fall. The bearing part 20 is thereby pivoted against the force of the release spring 40 about the pivot edge 27. As can be recognized in FIG. 4, the release plate 13 is thereby released from the shorter lever arms 36 of the toggle levers 35. This enables first an almost force-free swiveling of the toggle levers 35 for effecting a lateral release. FIGS. 4 and 5 show furthermore that the spring 40 effects a loading of the extension 31 in a closing direction of the front jaw 1 through the lower end 14 of the release plate 13. The extension 31 and the control surface 15 touch one another thereby at various points or lines depending on the degree of swiveling. The pointed design of the projection 7 permits, in cooperation with the recess 30, a lateral swiveling of the bearing part 20.

Figure 3:
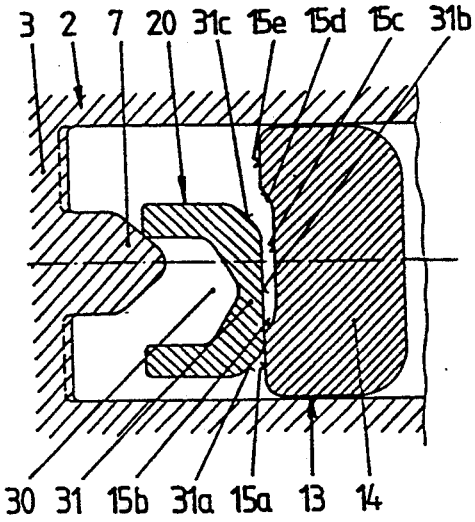
FIG. 3 is an illustration similar to FIG. 2 with a laterally swiveled bearing part.

FIG. 3 shows, in a simplified manner, the position of the extension 31 relative to the control surface 15 during a backward twisting fall. The extension 31 contacts here with its section 31*b* extending approximately transversely with respect to the longitudinal axis of the ski the first section 15*a* of the control surface 15.

It will be readily recognized that the aforementioned cooperation between the extension 31 and the control surface 15 will cause the release plate 13 to be urged farther in the opening direction (to the right in the drawing). This increases at the same time the distance between the upper section of the release plate 13 and the rearwardly facing bearing surface 24 of the bearing part 20, thus increasing the zone of the force-free swiveling of the toggle levers 35. An excessive upward pivoting of the sole holder 37 to thus cause an undesired release of the ski shoe is prevented by the swivel path of the bearing part 20 being limited by the stop 16 of the release plate 13 striking the path-defining means 8.

The invention is not to be limited to the exemplary embodiment illustrated in the drawings and described above. Rather various modifications of the same are possible without departing from the scope of the invention. For example, it would be possible to extend the path-defining means provided on the housing in upward direction so that it stops at the same time snow from penetrating into the ski binding.

We claim:

1. A front jaw of a ski binding, comprising:

a housing adapted to be fastened to an upper surface of a ski, in which housing is housed a release spring;

a pull rod reciprocally movably supported in said housing;

a release plate secured to one end of said pull rod;

a bearing part mounted on said housing, said bearing part having means defining an opening therethrough receiving said pull rod therein, said bearing part having a rearwardly extending projection on a lower end section to define an abutment for said release plate;

a pair of two-arm toggle levers pivotally mounted on said bearing part for pivotal movement about a vertically extending axis between an initial position thereof and a ski shoe release position, each toggle lever having a longer arm and a shorter arm, said longer arms each including means for clamping a sole of a ski shoe to hold the ski shoe on said ski;

a release spring for biasing said pull rod to a further initial position thereof and to urge said toggle levers to said initial position thereof; and means defining a control surface in a lower section of said release plate on a side opposing said bearing part, said control surface, viewed in a side view longitudinal cross section, extending upwardly and forwardly from a bottom portion thereof, and said rearwardly extending projection on said bearing part engaging said control surface during an occurrence of an upwardly directed force acting on said longer arms, whereby said bearing part pivots release to said housing when acted upon by a vertical force, and said control surface on said release plate engages said rearwardly extending projection on said bearing part and biases said bearing part against pivoting vertically since said release plate is loaded by said release spring.

2. The front jaw according to claim 1, wherein said control surface of said release plate has a continuously curved shape when viewed in a top view.

3. The front jaw according to claim 1, wherein both said control surface of said release plate and also said rearwardly extending projection of said bearing part have a curvelike shape, when viewed from the top, the two curvelike shapes being generally congruent with one another.

4. The front jaw according to claim 3, wherein said control surface comprises a first section extending generally transversely with respect to a longitudinal axis of the ski, contiguous to which and in series is a rearwardly curved second section, a third section extending generally transversely with respect to the longitudinal axis of the ski, a forwardly curved fourth section and a fifth section extending again generally transversely with respect to the longitudinal axis of the ski, and wherein said rearwardly extending projection of said bearing part having a contiguous and series connected generally rearwardly curved first section, a second section extending generally transversely with respect to the longitudinal axis of the ski, and a forwardly curved third section.

* * * * *

UNITED STATES PATENT AND TRADEMARK OFFICE

CERTIFICATE OF CORRECTION

PATENT NO. : 5 257 798

DATED : November 2, 1993

INVENTOR(S) : Karl STRITZL et al.

It is certified that error appears in the above-identified patent and that said Letters Patent is hereby corrected as shown below:

Column 4, line 35; change "re-" to ---relative---.
line 36; delete "lease".

Signed and Sealed this

Nineteenth Day of April, 1994

Bruce Lehman

*Attest:*

BRUCE LEHMAN

*Attesting Officer*

*Commissioner of Patents and Trademarks*